US011733008B1

(12) United States Patent
Burnsed, Jr.

(10) Patent No.: US 11,733,008 B1
(45) Date of Patent: Aug. 22, 2023

(54) DUAL INITIATOR COUPLER KIT

(71) Applicant: Blue Force Gear, Inc., Pooler, GA (US)

(72) Inventor: Ashley A. Burnsed, Jr., Savannah, GA (US)

(73) Assignee: BLUE FORCE GEAR, INC., Pooler, GA (US)

( * ) Notice: Subject to any disclaimer, the term of this patent is extended or adjusted under 35 U.S.C. 154(b) by 0 days.

(21) Appl. No.: 17/234,843

(22) Filed: Apr. 20, 2021

Related U.S. Application Data

(60) Provisional application No. 63/013,461, filed on Apr. 21, 2020.

(51) Int. Cl.
*F42B 3/26* (2006.01)
*F42D 1/04* (2006.01)

(52) U.S. Cl.
CPC . *F42B 3/26* (2013.01); *F42D 1/04* (2013.01)

(58) Field of Classification Search
CPC ..... F42B 3/26; F42D 1/04
USPC ..... 102/275.12
See application file for complete search history.

(56) References Cited

U.S. PATENT DOCUMENTS 3,955,504 A * 5/1976 Romney ..... F42B 3/00 102/306
4,126,239 A * 11/1978 Gehrig ..... F42B 3/00 220/4.23
4,952,167 A * 8/1990 Hertelendy ..... H01R 4/4818 439/439
6,196,131 B1 * 3/2001 Yanda ..... F42D 1/045 102/275.12
6,546,873 B1 * 4/2003 Andrejkovics ..... F42D 1/045 102/202.5
7,591,483 B2 * 9/2009 Nakayasu ..... B60R 21/2644 280/736
11,306,565 B2 * 4/2022 Newell ..... F42B 1/028
2017/0184379 A1 * 6/2017 Barzilai ..... F42D 3/00
2021/0032951 A1 * 2/2021 Angstmann ..... E21B 33/064

FOREIGN PATENT DOCUMENTS

EP 3294691 B1 * 9/2020 ..... C06C 5/06
WO WO-2022086407 A1 * 4/2022

* cited by examiner

*Primary Examiner* — Samir Abdosh
(74) *Attorney, Agent, or Firm* — Bennet K. Langlotz; Langlotz Patent & Trademark Works, LLC

(57) ABSTRACT

An explosive initiator retention assembly comprises a pair of opposed shell elements. The shell elements have a pair of spaced-apart passages, each configured to receive an elongated initiator having a cylindrical form. Each passage has a rotation inhibitor element configured to rotationally engage an initiator, such the initiators are retained against rotation.

1 Claim, 4 Drawing Sheets

SECTION A-A

CONFIDENTIAL

DUAL INITIATOR COUPLER KIT

CROSS-REFERENCE TO RELATED APPLICATIONS

This application claims the benefit of U.S. Provisional Patent Application No. 63/013,461, filed on Apr. 21, 2021, entitled "DUAL INITIATOR COUPLER KIT", which is hereby incorporated by reference in its entirety for all that is taught and disclosed therein.

FIELD OF THE INVENTION

The present invention relates to igniters.

BACKGROUND AND SUMMARY

M81 igniters are commonly used to initiate the shock tube or M700 Time Fuse of MDI (modern demolitions initiative) blasting caps when breaching walls, doors, etc.

As a failsafe, end users often install two MDI blasting caps next to each other. This is a time-intensive process involving taping them together securely.

The above disadvantage is addressed by an explosive initiator retention assembly that comprises a pair of opposed shell elements. The shell elements have a pair of spaced-apart passages, each configured to receive an elongated initiator having a cylindrical form. Each passage has a rotation inhibitor element configured to rotationally engage an initiator, such the initiators are retained against rotation.

DETAILED DESCRIPTION OF A PREFERRED EMBODIMENT

Figure 1:
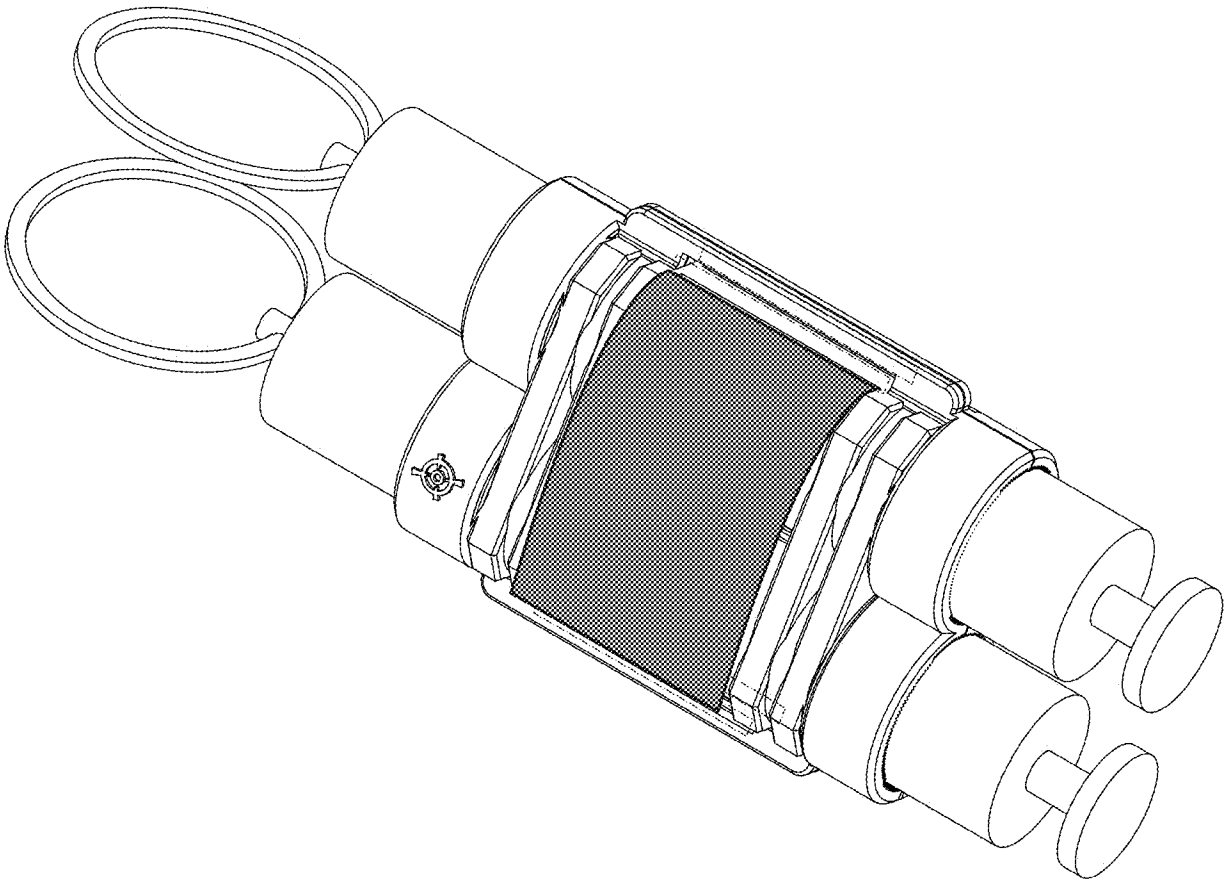
FIG. 1 shows the D.I.C.K closed, encasing two ignitors, and ready for instant use.
Figure 2:
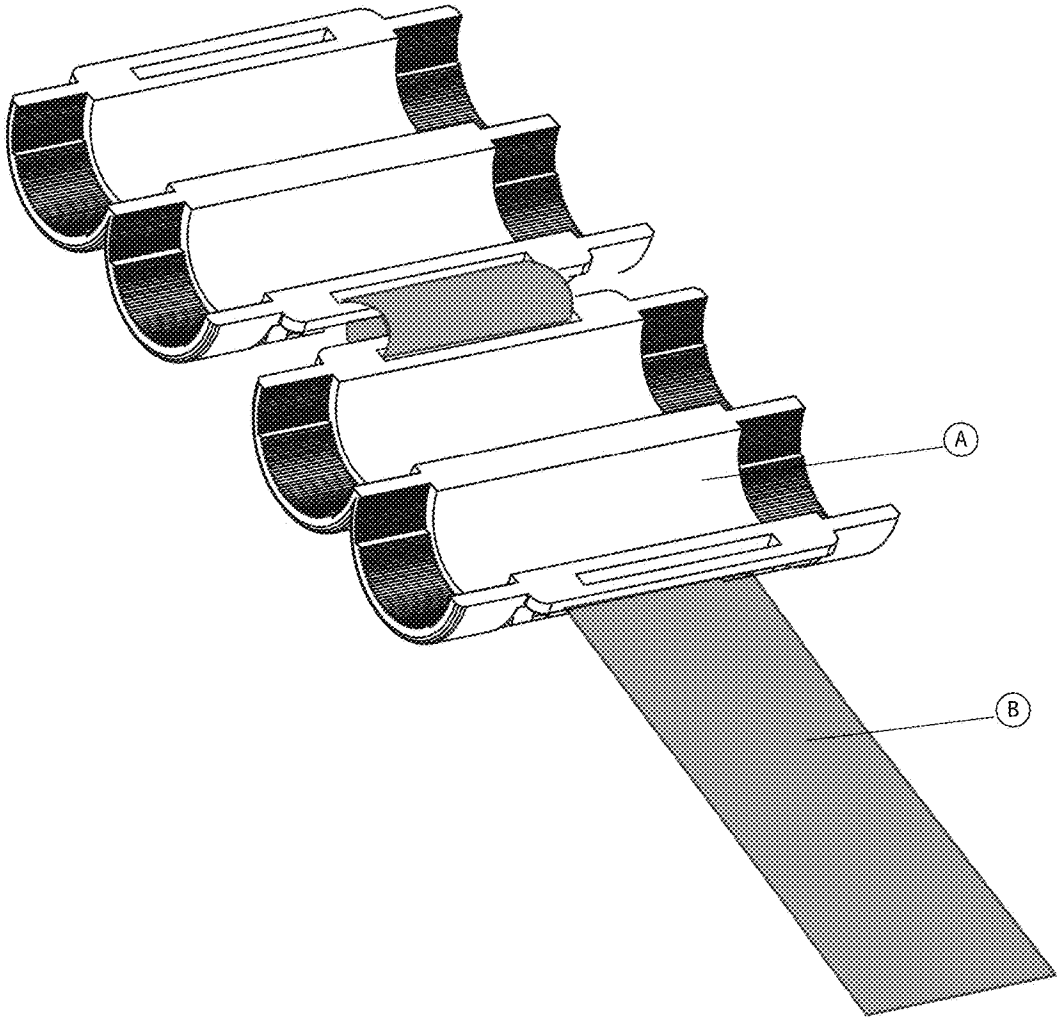
FIG. 2 shows the D.I.C.K. consists of two symmetrical hard bodies (A) hinged together with a length of 1" One Wrap webbing (B). The One Wrap webbing is designed to wrap around both bodies and to fasten back onto itself in order to securely encase two M81 igniters. Note the texture located on the internal surface of Part A to help prevent rotation of the M81 igniters during their initiation.
Figure 3:
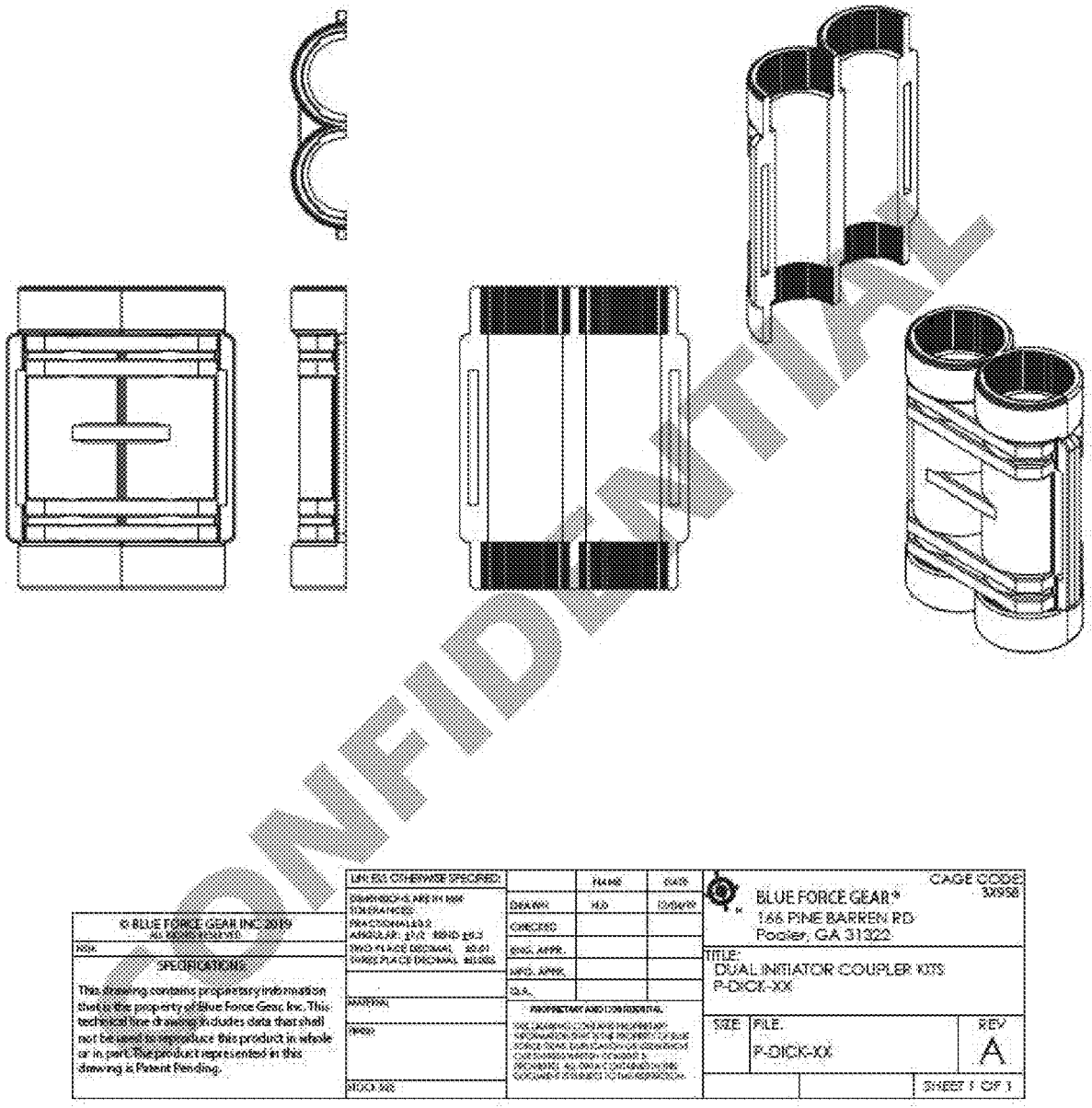
FIG. 3 shows technical drawings of the two symmetrical hard bodies of Part A from numerous angles and sides, while empty.
Figure 4:
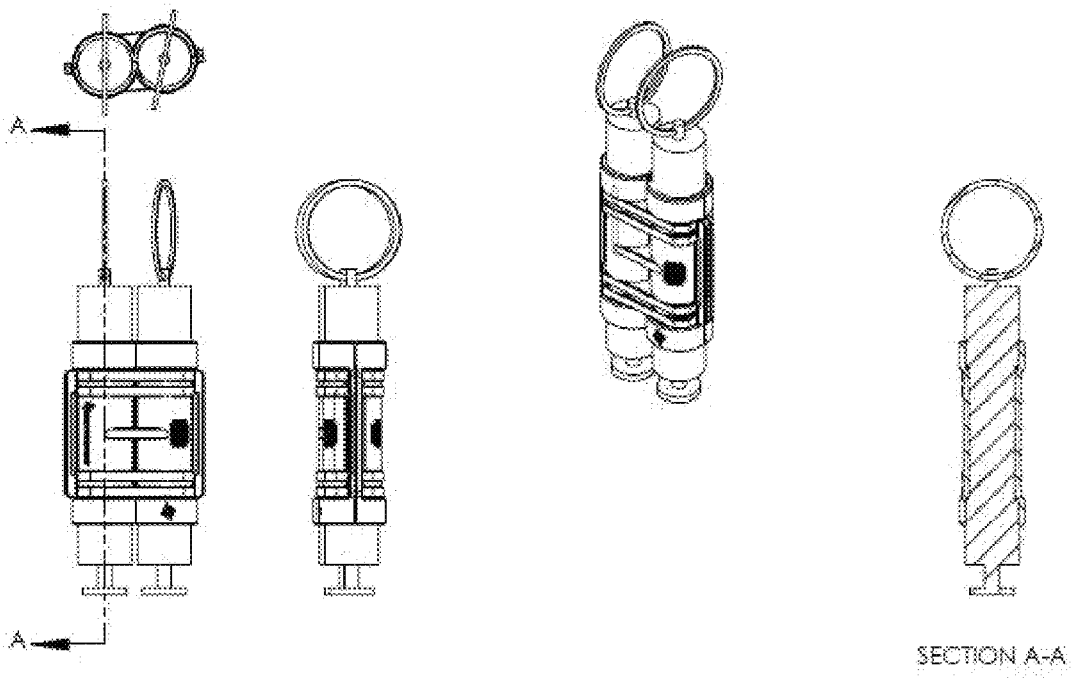
FIG. 4 shows technical drawings of the two symmetrical hard bodies encasing the ignitor devices, including: a broad-side view; a narrow side-view; a view from the top; an angled view from slightly above; and a cross-section.

M81 igniters are commonly used to initiate the shock tube or M700 Time Fuse of MDI (modern demolitions initiative) blasting caps when breaching walls, doors, etc.

As a failsafe, end users often install two MDI blasting caps next to each other. This is a time-intensive process involving taping them together securely.

The Dual Initiator Coupler Kit (D.I.C.K) allows users to quickly secure two ignitors in the correct position for breaching needs.

I claim:

1. An explosive initiator retention assembly kit comprising;

a pair of opposed shell elements hingedly coupled together;

the shell elements together defining a pair of spaced-apart passages each configured to receive an elongated initiator having a cylindrical form; and each passage defining a rotation inhibitor element configured to rotationally engage an initiator, such the initiators are retained against rotation.

* * * * *